US006191742B1

(12) United States Patent
Ha et al.

(10) Patent No.: US 6,191,742 B1
(45) Date of Patent: Feb. 20, 2001

(54) WHIP ANTENNA STRUCTURE OF MOBILE TERMINAL

(75) Inventors: Dong-In Ha, Seoul; Konstantin Stanialavovich Krylov, Sywon; Dong-Hwan Kim, Seoul; Seong-Joong Kim, Namyangju, all of (KR)

(73) Assignee: Samsung Electronics Co., Ltd. (KR)

( * ) Notice: Under 35 U.S.C. 154(b), the term of this patent shall be extended for 0 days.

(21) Appl. No.: 09/443,709

(22) Filed: Nov. 19, 1999

(30) Foreign Application Priority Data

Nov. 19, 1998 (KR) ..... 98-49718

(51) Int. Cl.[7] ..... H01Q 1/24
(52) U.S. Cl. ..... 343/702; 455/90
(58) Field of Search ..... 343/702, 895, 343/901, 902, 903

(56) References Cited

U.S. PATENT DOCUMENTS

| | | | | |
|---|---|---|---|---|
| 5,204,678 | | 4/1993 | Foley | 341/152 |
| 5,479,178 | | 12/1995 | Ha | 343/702 |
| 5,999,133 | * | 12/1999 | Svensson | 343/702 |

* cited by examiner

*Primary Examiner*—Don Wong
*Assistant Examiner*—James Clinger
(74) *Attorney, Agent, or Firm*—Dilworth & Barrese, LLP

(57) ABSTRACT

An antenna structure of a mobile terminal includes a whip antenna, a helical antenna mounted to the mobile terminal and pierced with the whip antenna in a lengthwise direction thereof, a bushing for fixing the helical antenna to the mobile terminal and connecting the helical antenna or the whip antenna to a radio frequency (RF) block, a projection for stopping extension of the whip antenna, a driving motor for generating a driving force to retract/extend the whip antenna according to a specified control signal, and rollers for transmitting torque generated from the driving motor to the whip antenna to be retracted/extended. The whip antenna includes: a non-conducting upper portion disposed at a position of the helical antenna when the whip antenna is retracted; an intermediate portion including a conducting wire isolated with an insulating material of a predetermined thickness, and a conducting connection having a predetermined width to be coupled to the bushing when the whip antenna is extended; and a non-conducting lower portion having the projection at the lower end thereof, wherein the upper portion, the intermediate portion and the lower portion are equal in diameter.

2 Claims, 14 Drawing Sheets

File: 6700RZ54.DAT
Date: 03-Nov-98
Time: 10:20
Operator: JKKang
Ser. no.: 00
Channel: Wide band
Frequency: See Legend SPH-6700, normal position of contact spring RET, azimuth plane
TOTAL SILVER paint in front & rear case
ADD gaskit in wall, finger in M/C Tx pol: Horiz. Rx pol: Horiz.

Calibration status:
File: CALVHRNM.DAT
Chan.: 1710-1990M
Table: 1710-1990
Units: dBi

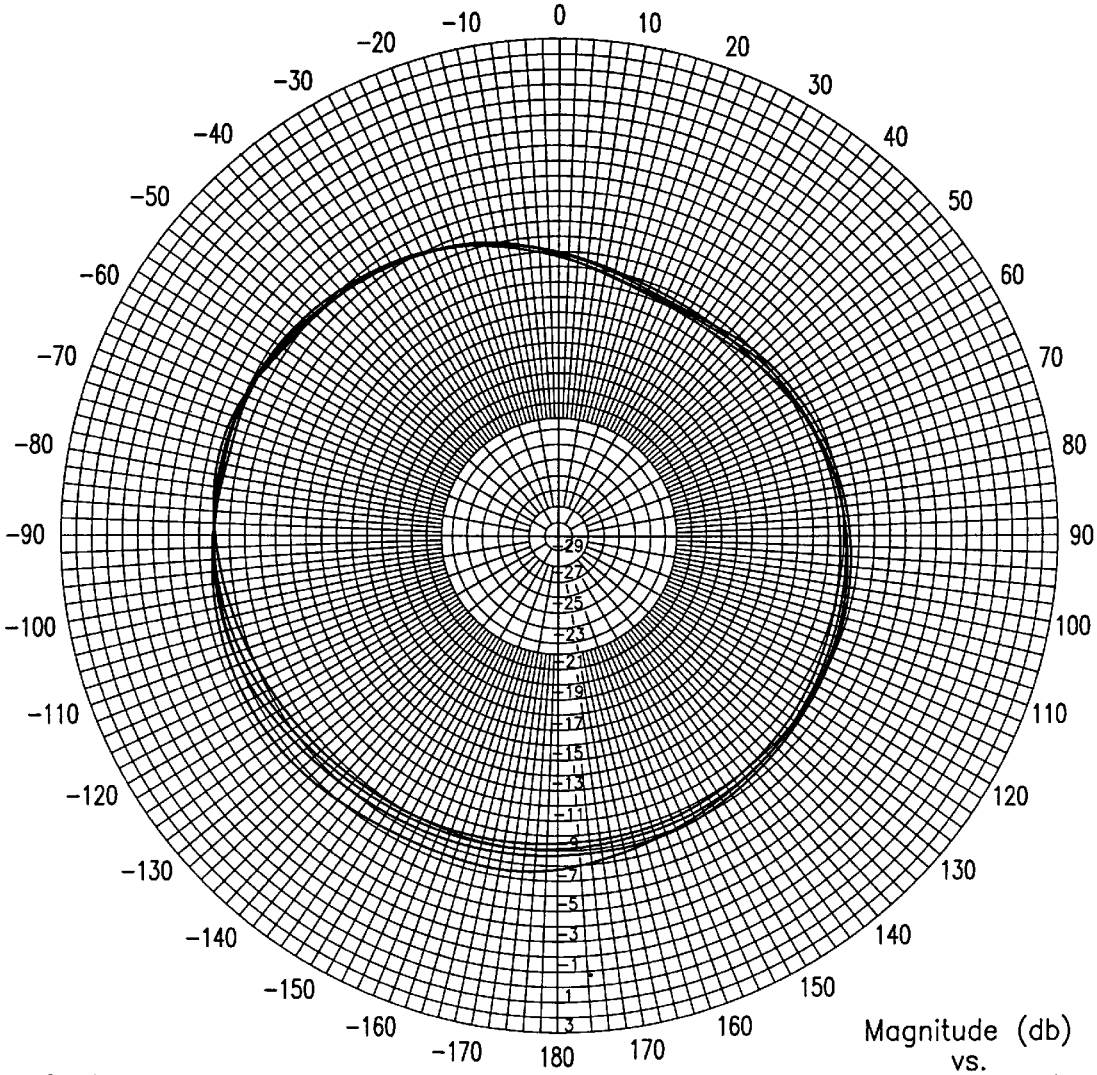

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 6A*

File: 4000VEXT.DAT SPH-4000, Ref, chassis
Date: 07-Sep-98 Ext, azimuth plane
Time: 8:36
Operator: DHKim
Ser. no.: 00
Channel: Wide band Tx pol: Horiz. Rx pol: Horiz.
Frequency: See Legend Calibration status:
File: CALVHRNM.DAT
Chan.: 1710-1990M
Table: 1710-1990
Units: dBi

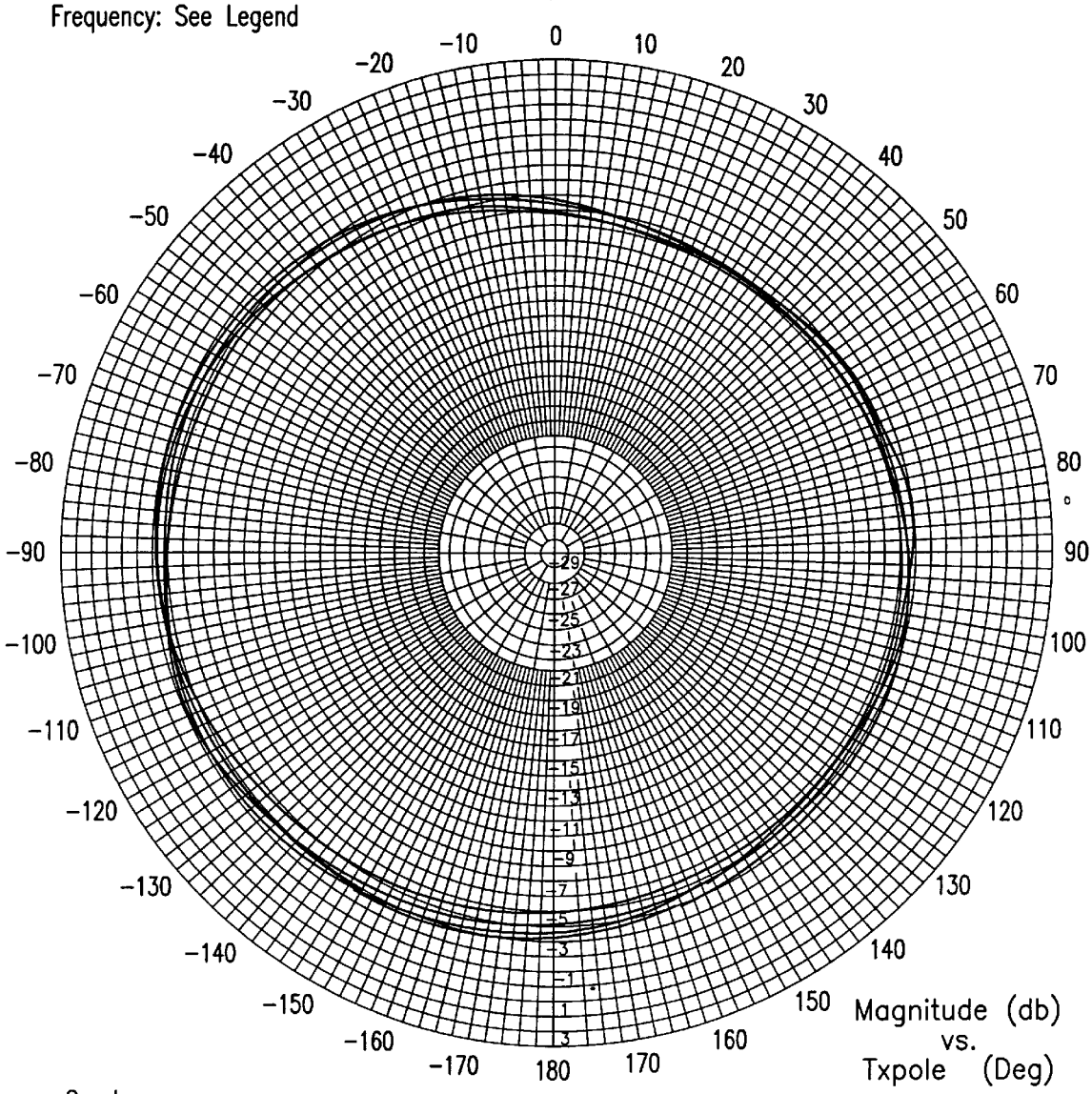

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 6B*

File: 4000RTE2.DAT
Date: 19-Oct-98
Time: 9:56
Operator: JKKang
Ser. no.: 00
Channel: Wide band
Frequency: See Legend SPH-4000, Reference
Retracted, E2 plane
4pf series. 0.5pf shunt
duplexer Tx pol: Horiz. Rx pol: Horiz.

Calibration status:
File: CALVHRNM.DAT
Chan.: 1710-1990M
Table: 1710-1990
Units: dBi

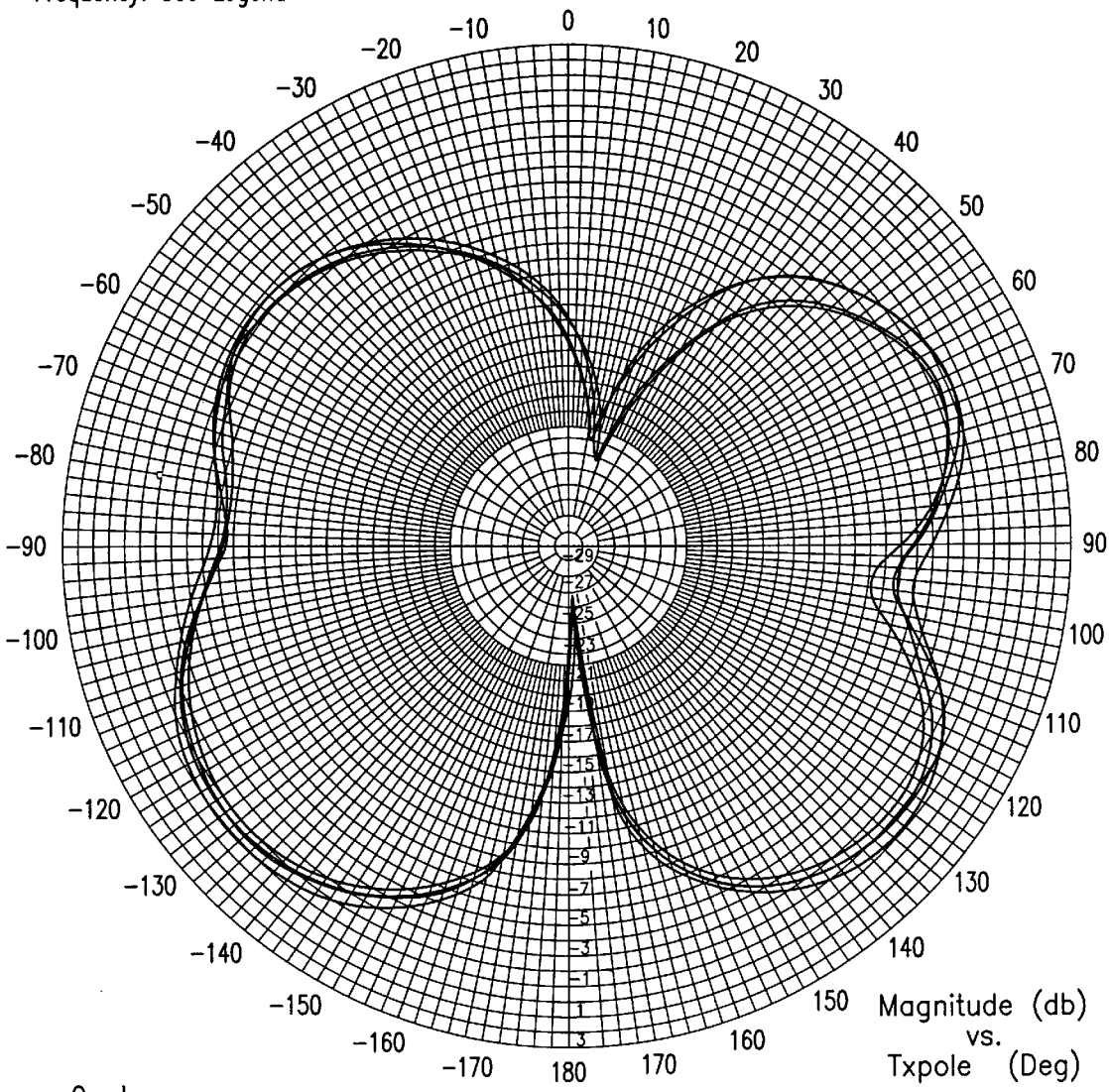

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 6C*

File: 4000EXE2.DAT
Date: 19-Oct-98
Time: 9:59
Operator: JKKang
Ser. no.: 00
Channel: Wide band
Frequency: See Legend SPH-4000, Reference
Extended, E2 plane
4pf series, 0.5pf shunt
duplexer Tx pol: Horiz. Rx pol: Horiz.

Calibration status:
File: CALHHRNM.DAT
Chan.: 1710-1990M
Table: 1710-1990
Units: dBi

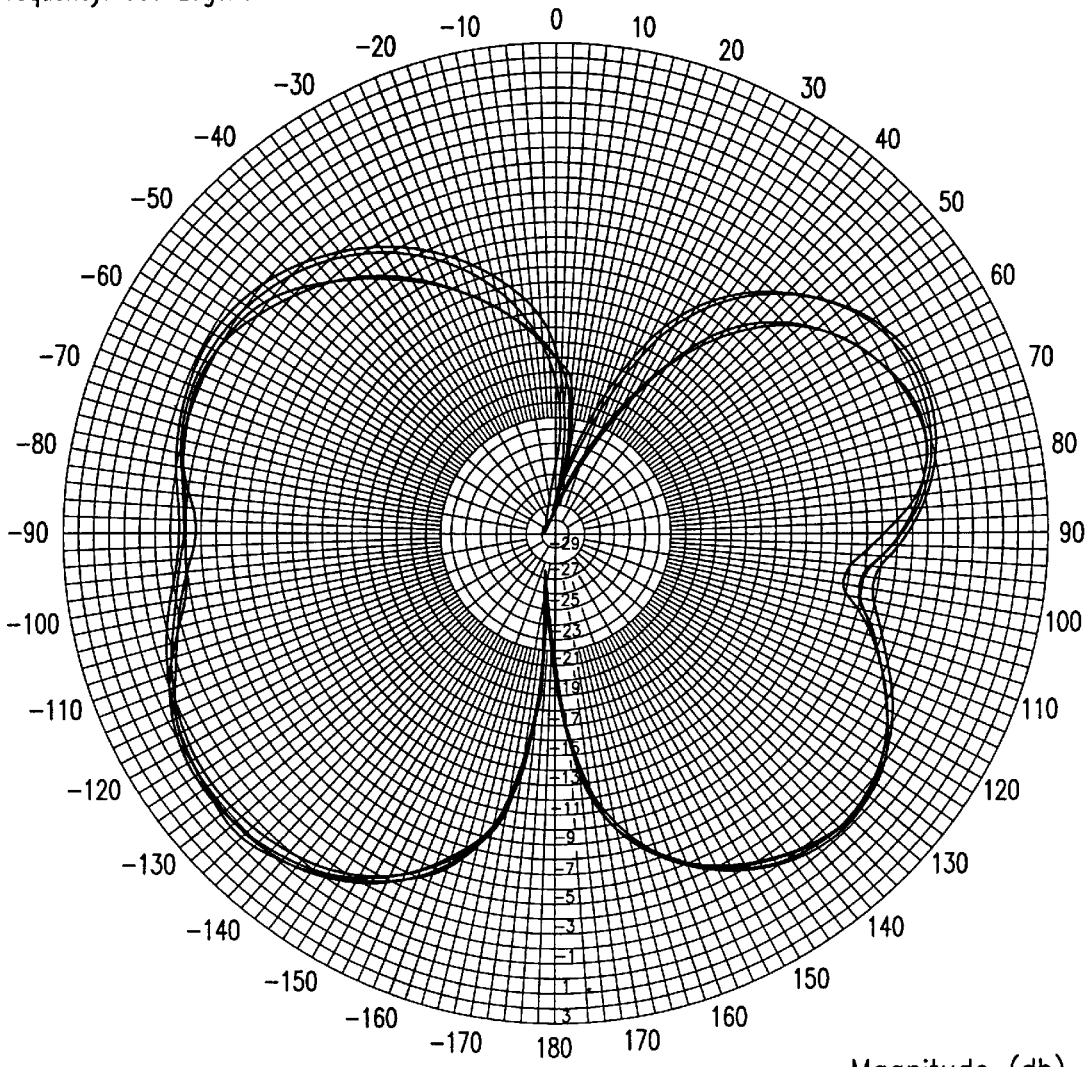

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 6D*

File: 4000VRET.DAT
Date: 07-Sep-98
Time: 8:31
Operator: DHKim
Ser. no.: 00
Channel: Wide band
Frequency: See Legend SPH-4000, Ref. chassis
Ret. azimuth plane Tx pol: Horiz. Rx pol: Horiz.

Calibration status:
File: CALVHRNM.DAT
Chan.: 1710-1990M
Table: 1710-1990
Units: dBi

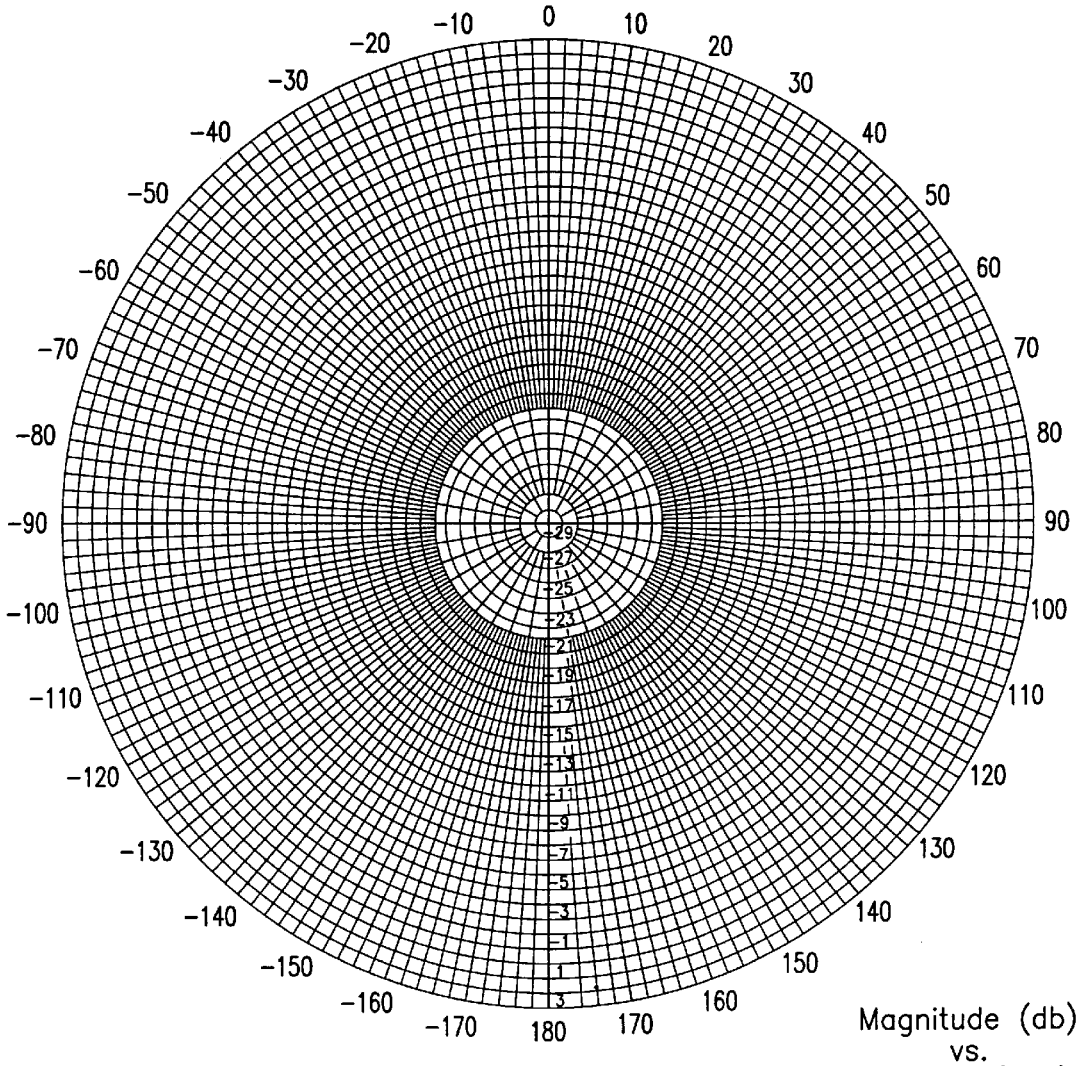

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 8A*

File: 6700RZ55.DAT
Date: 03-Nov-98
Time: 19:24
Operator: JKKang
Ser. no.: 00
Channel: Wide band
Frequency: See Legend SPH-6700, normal position of contact spring
EXT. azimuth plane
TOAL SILVER paint in fron&rear case
ADD gaskit in wall. finger in M/C Tx pol: Horiz. Rx pol: Horiz.

Calibration status:
File: CALVHRNM.DAT
Chan.: 1710-1990M
Table: 1710-1990
Units: dBi

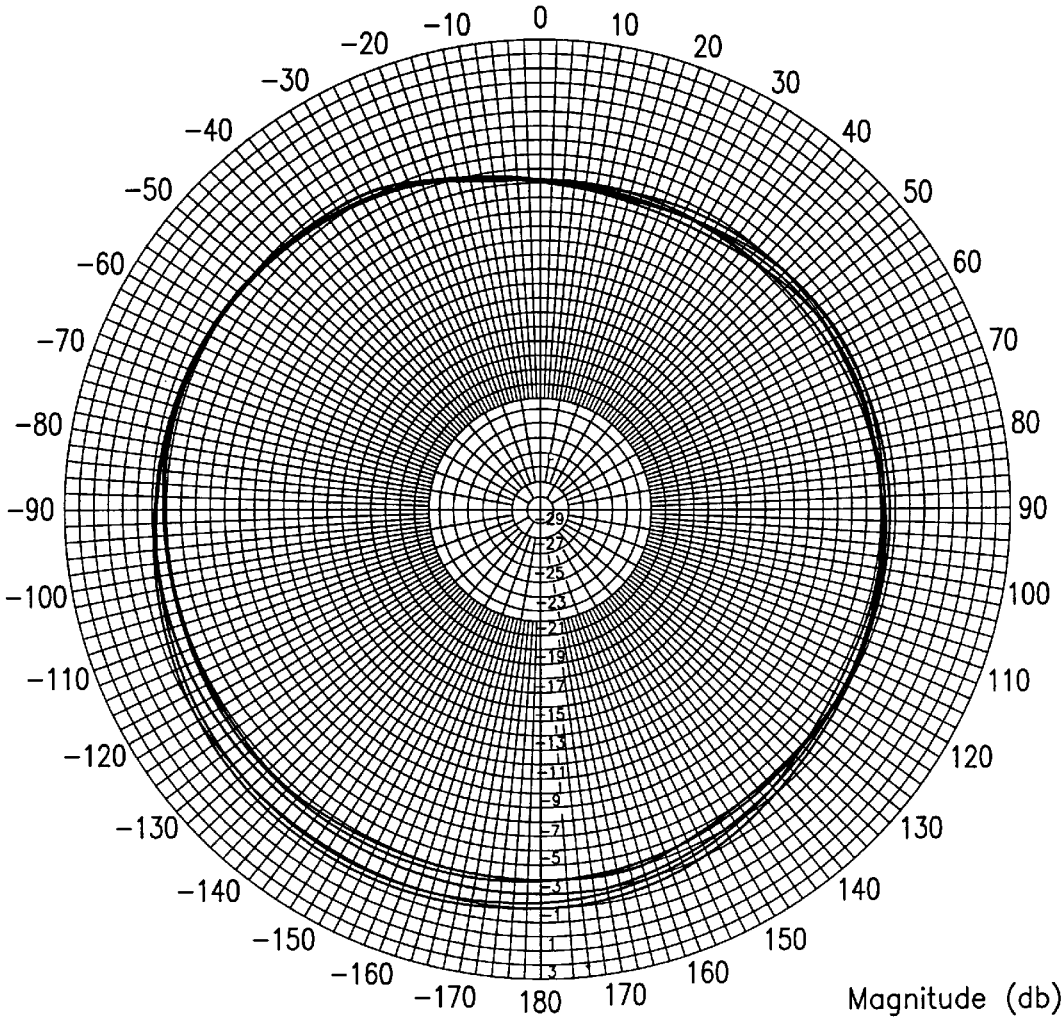

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 8B*

File: 6700RZ56.DAT
Date: 03-Nov-98
Time: 19:40
Operator: JKKang
Ser. no.: 00
Channel: Wide band
Frequency: See Legend SPH-6700, normal position of contact spring
RET. E2 plane
TOTAL SILVER paint in front&rear case
ADD gaskit in wall, finger in M/C Tx pol: Horiz. Rx pol: Horiz.

Calibration status:
File: CALHHRNM.DAT
Chan.: 1710-1990M
Table: 1710-1990
Units: dBi

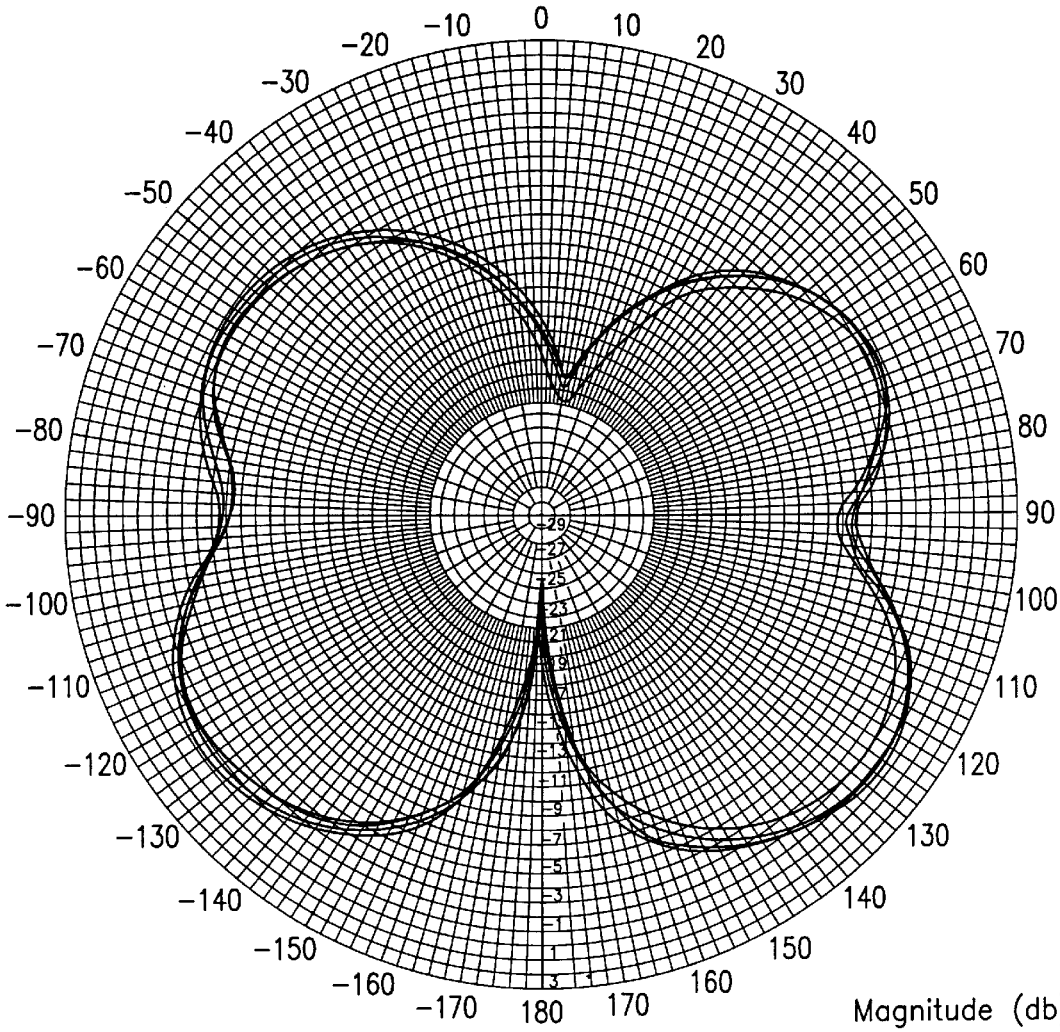

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 8C*

File: 6700RZ57.DAT
Date: 03-Nov-98
Time: 19:45
Operator: JKKang
Ser. no.: 00
Channel: Wide band
Frequency: See Legend SPH-6700, normal position of contact spring
RET. E2 plane
TOTAL SILVER paint in front&rear case
ADD gaskit in wall, finger in M/C Tx pol: Horiz. Rx pol: Horiz.

Calibration status:
File: CALHHRNM.DAT
Chan.: 1710-1990M
Table: 1710-1990
Units: dBi

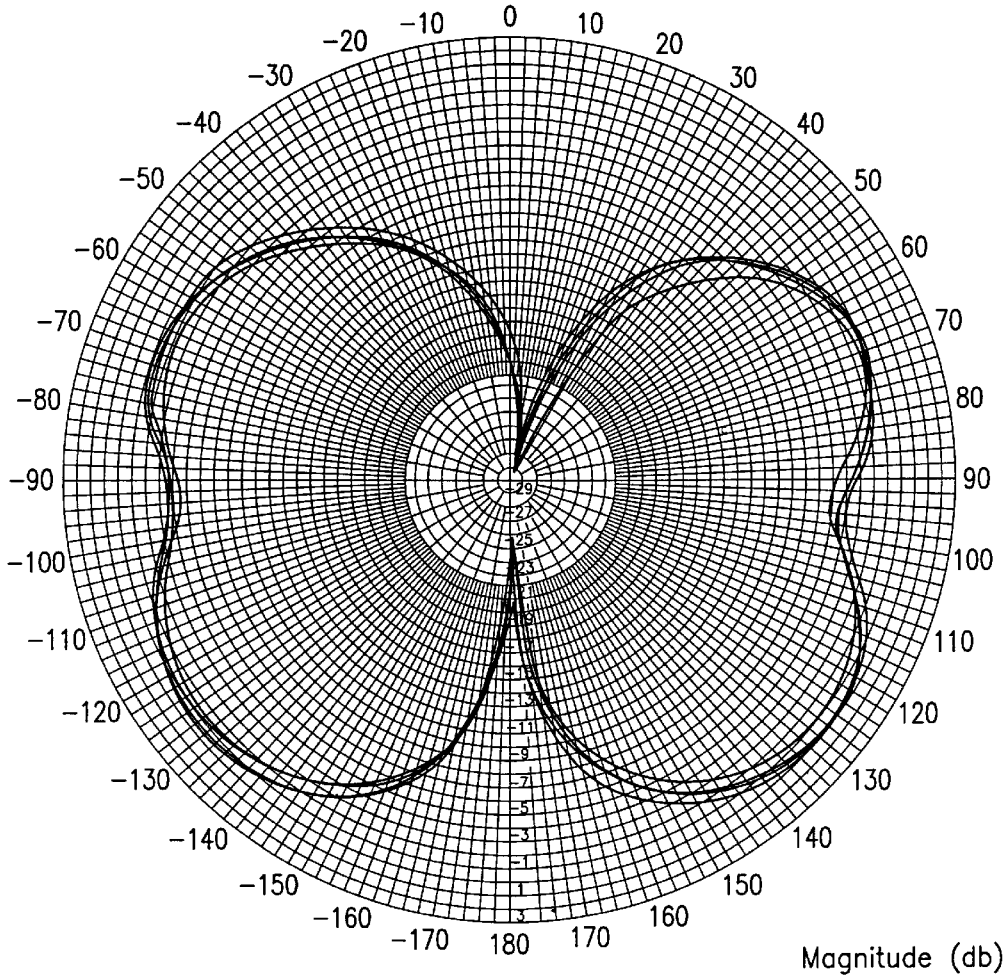

Magnitude (db)
vs.
Txpole (Deg)

Overlays
Frequency: 1.750 GHz
Frequency: 1.765 GHz
Frequency: 1.780 GHz
Frequency: 1.840 GHz
Frequency: 1.855 GHz
Frequency: 1.870 GHz FR959
Automated Antenna
Measurement System

*FIG. 8D*

WHIP ANTENNA STRUCTURE OF MOBILE TERMINAL

PRIORITY

This application claims priority to an application entitled "Whip Antenna Structure of Mobile Terminal" filed in the Korean Industrial Property Office on Nov. 19, 1998 and assigned Ser. No. 98-49718, the contents of which are hereby incorporated by reference.

BACKGROUND OF THE INVENTION

1. Field of the Invention

The present invention relates generally to an antenna device of a mobile terminal, and more particularly, to a whip antenna structure of a mobile terminal having a non-conducting projection at the lower end of the whip antenna.

2. Description of the Related Art

Generally, mobile terminals have an antenna device for data communication, which includes a helical antenna and a whip antenna.

An example of this type of the mobile terminal is shown in U.S. Pat. No. 5,204,678, in which the helical antenna is incorporated with the upper portion of the whip antenna. In this patent, the mobile terminal further includes a conducting projection electrically connected to the whip antenna, and an antenna bushing for fixing a receiving means and the antenna to the terminal. When retracting the whip antenna, the helical antenna descends in the retracting direction of the whip antenna so that a connector electrically connected to the helical antenna is electrically connected to a spring clip provided in the antenna bushing. Here, only the helical antenna operates since the whip antenna is electrically isolated from the helical antenna.

In another type of the mobile terminal, the helical antenna is mounted to the main body of the mobile terminal. An example of this mobile terminal is disclosed in U.S. Pat. No. 5,479,178, in which the whip antenna includes a conducting projection electrically connected to a conducting wire, and an antenna bushing for fixing a receiving means and the antenna to the mobile terminal. When the whip antenna is retracted, only the helical antenna is used; and otherwise when the whip antenna is extended, the projection is brought in contact with the spring clip to allow the whip antenna to be operated.

FIG. 1 is a cross section of a mobile terminal having an antenna with a conducting projection according to prior art.

Referring to FIG. 1, when extending a whip antenna 110, the conducting projection 119 is associated with a spring clip (not shown) provided in a bushing 120 so as to secure the whip antenna. However, there is a problem that the whip antenna cannot be extended when the spring force is stronger than a driving force of the antenna. Particularly, when using a small-sized driving motor 130 in order to miniaturize the mobile terminal, a force for extending the whip antenna 110 is too weak to allow the conducting projection 119 to be associated with the spring clip.

Further, the antenna having the driving motor 130 uses a power transmission device such as rollers 131 to impart an up-and-down motion to the whip antenna 110 to be extended/retracted. Here, the rollers 131 are positioned at the lower end of the bushing 120 for fixing the whip antenna. As illustrated in FIG. 1, the force transmitted from the motor 130 makes the rollers 131 rotate, thereby extending the whip antenna 110 between the rollers 131. As described previously, the conducting projection 119 is positioned lower than the bushing 120 due to the position of the rollers 131 such that the whip antenna is not entirely extracted from the mobile terminal and the conducting projection 119 is left in the mobile terminal. As a result, radiation and matching characteristics of the whip antenna are deteriorated. That is, in a general automotive antenna having a lower portion which includes a conductive stopper and an intermediate portion which has a different diameter for stopping extension of the antenna the whip antenna portion of the automatic antenna suffers deterioration of its radiation and matching characteristics.

SUMMARY OF THE INVENTION

It is, therefore, an object of the present invention to provide an antenna in a mobile terminal with enhanced reception gain.

It is another object of the present invention to provide an antenna that requires a minimal amount of power to drive a motor during retraction/extension of a whip antenna in a mobile terminal.

To achieve the above objects of the present invention, there is provided an antenna structure of a mobile terminal including a whip antenna, a helical antenna mounted to the mobile terminal and pierced with the whip antenna in a lengthwise direction thereof, a bushing for fixing the helical antenna to the mobile terminal and connecting the helical antenna or the whip antenna to a radio frequency (RF) block, a projection for stopping extension of the whip antenna, a driving motor for generating a driving force to retract/extend the whip antenna according to a specified control signal, and rollers for transmitting torque generated from the driving motor to the whip antenna to be retracted/extended. The whip antenna includes: a non-conducting upper portion disposed at a position adjacent the helical antenna when the whip antenna is retracted; an intermediate portion including a conducting wire isolated with an insulating material of a predetermined thickness, and a conducting connection having a predetermined width to be coupled to the bushing when the whip antenna is extended; and a non-conducting lower portion having the projection at the lower end thereof, wherein the upper portion, the intermediate portion and the lower portion are equal in diameter.

BRIEF DESCRIPTION OF THE DRAWINGS

The above and other objects, features and advantages of the present invention will become more apparent from the following detailed description when taken in conjunction with the accompanying drawings in which:

FIGS. 5*a* and 5*b* show a matching characteristic graph of the general mobile terminal wherein FIG. 5*a* illustrates a retracted state of the antenna and FIG. 5*b* illustrates an extended state thereof;

FIG. 6A shows a radiation characteristic at the bands of 1.75 GHz, 1.765 GHz, 1.780 GHz, 1.840 GHz, 1.855 GHz and 1.87 GHz when a mobile terminal is upright and its antenna is retracted;

FIG. 6B shows a radiation characteristic at the bands of 1.75 GHz, 1.765 GHz, 1.780 GHz, 1.840 GHz, 1.855 GHz and 1.87 GHz when a mobile terminal is upright and its antenna is extracted;

FIG. 6C shows a radiation characteristic at the bands of 1.75 GHz, 1.765 GHz, 1.780 GHz, 1.840 GHz, 1.855 GHz and 1.87 GHz when a mobile terminal is down and its antenna is retracted;

FIG. 6D shows a radiation characteristic at the bands of 1.75 GHz, 1.765 GHz, 1.780 GHz, 1.840 GHz, 1.855 GHz and 1.87 GHz when a mobile terminal is down and its antenna is extracted;

FIGS. 7*a* and 7*b* show a matching characteristic graph according to the present invention, wherein FIG. 7*a* illustrates a retracted state of the antenna and FIG. 7*b* illustrates an extended state thereof;

FIG. 8A shows a radiation characteristic at the bands of 1.75 GHz, 1.765 GHz, 1.780 GHz, 1.840 GHz, 1.855 GHz and 1.87 GHz when a mobile terminal, according to the present invention is upright and its antenna is retracted;

FIG. 8B shows a radiation characteristic at the bands of 1.75 GHz, 1.765 GHz, 1.780 GHz, 1.840 GHz, 1.855 GHz and 1.87 GHz when a mobile, according to the present invention is upright and its antenna is extracted;

FIG. 8C shows a radiation characteristic at the bands of 1.75 GHz, 1.765 GHz, 1.780 GHz, 1.840 GHz, 1.855 GHz and 1.87 GHz when a mobile terminal according to the present invention is lying down and its antenna is retracted; and FIG. 8D shows a radiation characteristic at the bands of 1.75 GHz, 1.765 GHz, 1.780 GHz, 1.840 GHz, 1.855 GHz and 1.87 GHz when a mobile terminal according to the present invention is lying down and its antenna is extracted.

DETAILED DESCRIPTION OF THE PREFERRED EMBODIMENT

Figure 1:
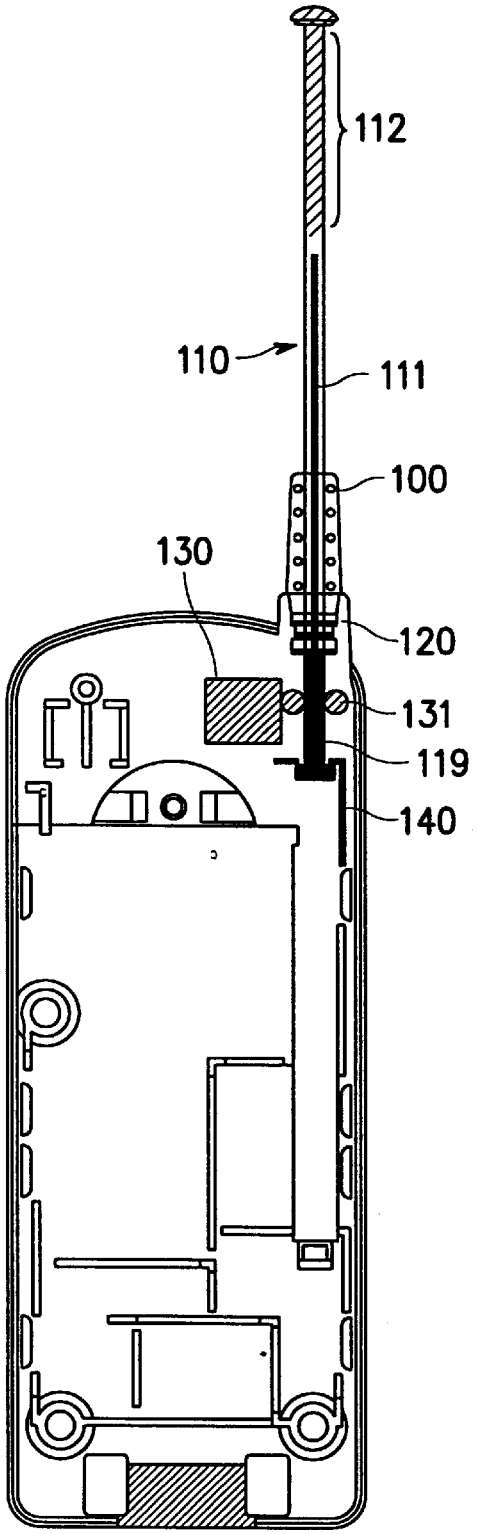
FIG. 1 is a cross section of a mobile terminal having an antenna with a conducting projection according to prior art.

A preferred embodiment of the present invention will be described below with reference to the accompanying drawings. It is to be noted that like reference numerals denote the same components in the drawings, and a detailed description of generally known function and structure of the present invention will be avoided so as not to obscure the subject matter of the present invention.

Figure 2:
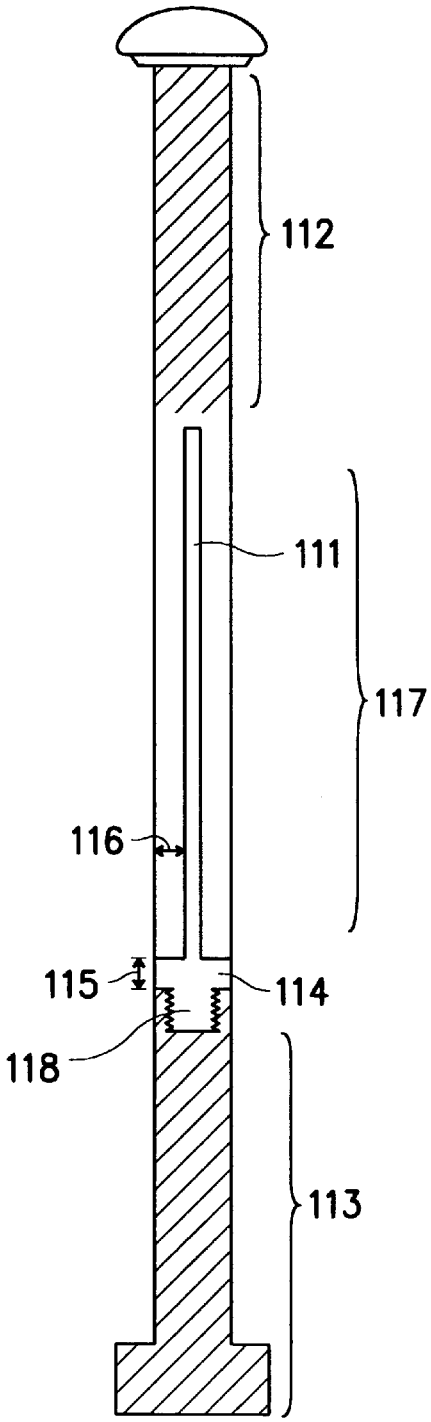
FIG. 2 is a cross section of a mobile terminal having an antenna with a non-conducting projection according to an embodiment of the present invention, in which the antenna is retracted.
Figure 3:
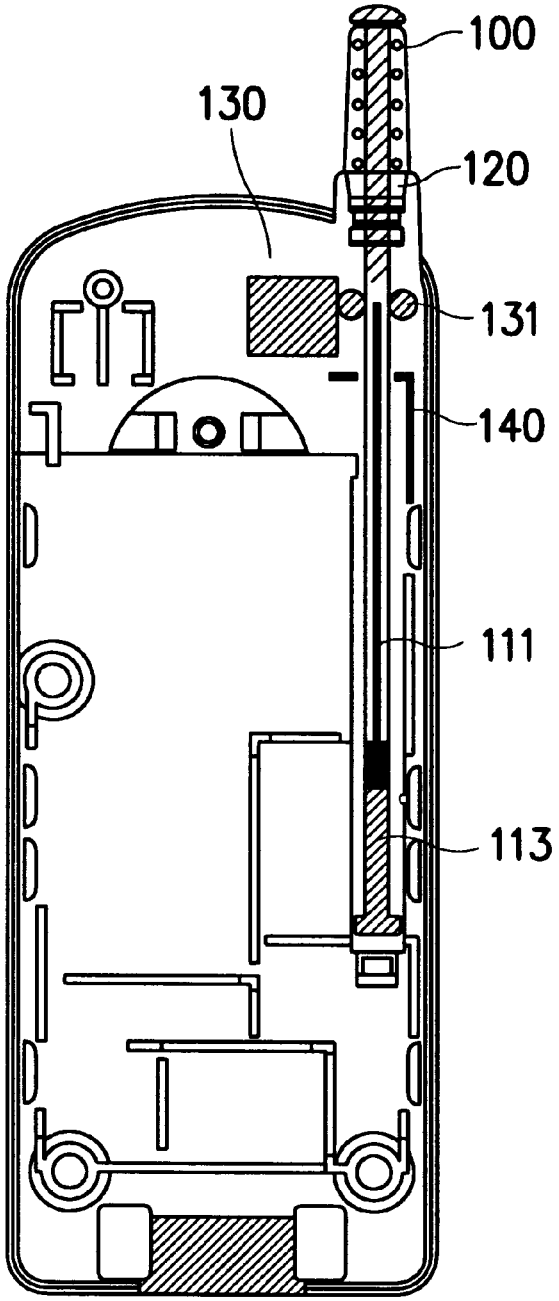
FIG. 3 is a cross section of a mobile terminal having an antenna with a non-conducting projection according to an embodiment of the present invention, in which the antenna is extended.
Figure 4:
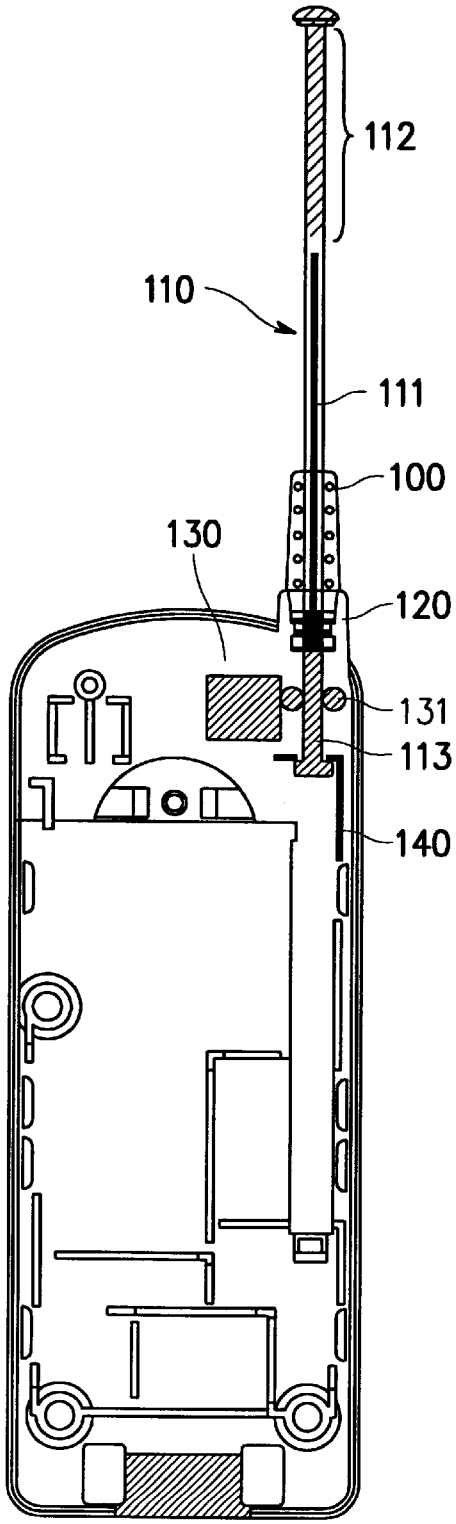
FIG. 4 is a cross section of a whip antenna with a non-conducting projection according to an embodiment of the present invention.

FIG. 2 is a cross section of a mobile terminal having an antenna with a non-conducting projection according to an embodiment of the present invention, in which the antenna is retracted; and FIG. 3 is a cross section of a mobile terminal having an antenna with a non-conducting projection according to an embodiment of the present invention, in which the antenna is extended. FIG. 4 is a cross section of a whip antenna with a non-conducting projection according to an embodiment of the present invention. FIG. 5 is a matching characteristic graph of a mobile terminal with a general antenna according to the prior art; and FIGS. 6A to 6D are radiation characteristic graphs of the mobile terminal with the general antenna. FIG. 7 is a matching characteristic graph of a mobile terminal with an antenna according to the present invention; and FIGS. 8A to 8D are radiation characteristic graphs of the mobile terminal with the antenna of the present invention.

Now, reference will be made in connection with FIG. 4 as to a whip antenna with a non-conducting projection according to the present invention.

As shown in FIG. 4, the whip antenna structure of the present invention includes an upper portion 112 made of a non-conducting material, an intermediate portion 117 including a conducting wire 111 and a connection 114 coupled to a bushing 120 (as shown in FIG. 3), and a lower portion, i.e., a projection 113 made of a non-conducting material. The upper portion 112, the intermediate portion 117 and the lower portion 113 are equal in diameter in order to assist in the operation of a motor 130 in retracting/extending the whip antenna 110.

A problem in the prior art antenna devices lies in that driving motor 130 is overstrained because the projection 113 to be connected to the bushing 120 is generally not equal in diameter to the upper and intermediate portions. To overcome this problem, the present invention is designed to have the upper portion 112, the intermediate portion 117 and the lower portion 113 of the same diameter and provided with the connection 114 of a same diameter for coupling the whip antenna 110 to the bushing 120. The connection 114 is not in direct contact with the bushing 120 but coupled to the bushing 120 in a short-circuited state due to radio frequency characteristics. Therefore, the wire 111 can operate without the connection 114 essentially in the same manner as in a short-circuited state so long as it is separated from the bushing 120 by a predetermined distance 116. The connection 114 has a width 115 variable in proportion to the length of the bushing 120. It is shown in FIG. 4 that the connection 114 is exposed to the exterior. But, the connection 114 can be isolated with an insulation material of a predetermined thickness. When the connection 114 is exposed to the exterior as illustrated in FIG. 4, the intermediate portion 117 is connected to the lower portion 113 via connection 118.

FIG. 2 shows a situation where the whip antenna 110 as constructed above is retracted into the mobile terminal. It can be seen from the drawing that the distal end of the wire 111 is separated from the lower end of the bushing 120 by a predetermined distance. This is to avoid any obstacle to the helical antenna 100 receiving electrical waves when the whip antenna 110 is retracted. With the whip antenna 110 retracted, the mobile terminal receives electrical waves only with the helical antenna connected to the bushing 120.

Now, a description will be made in connection with FIG. 3 as to a situation where the whip antenna 110 is extended. The driving motor 130 operates according to a specified control signal and transfers its torque to the rollers 131, allowing the whip antenna 110 to be extended. The non-conducting projection 113 is suspended on a stopper 140 when the whip antenna 110 is completely extended. Here, the connection 114 provided at the lower end of the intermediate portion 117 is disposed at the position of the bushing 120.

Figure 5A:
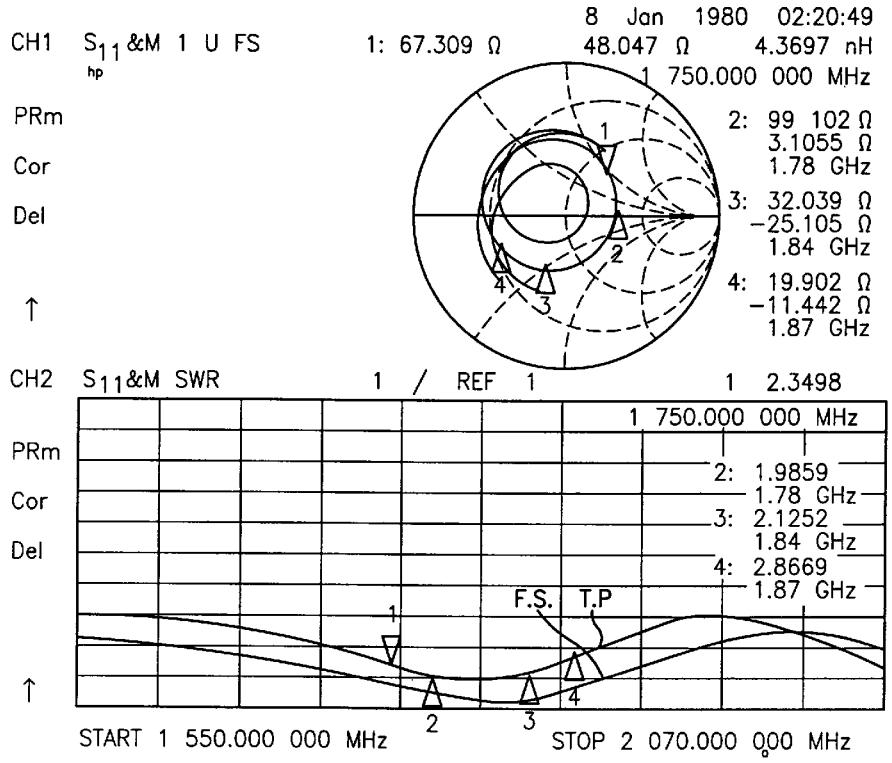
Figure 5B:
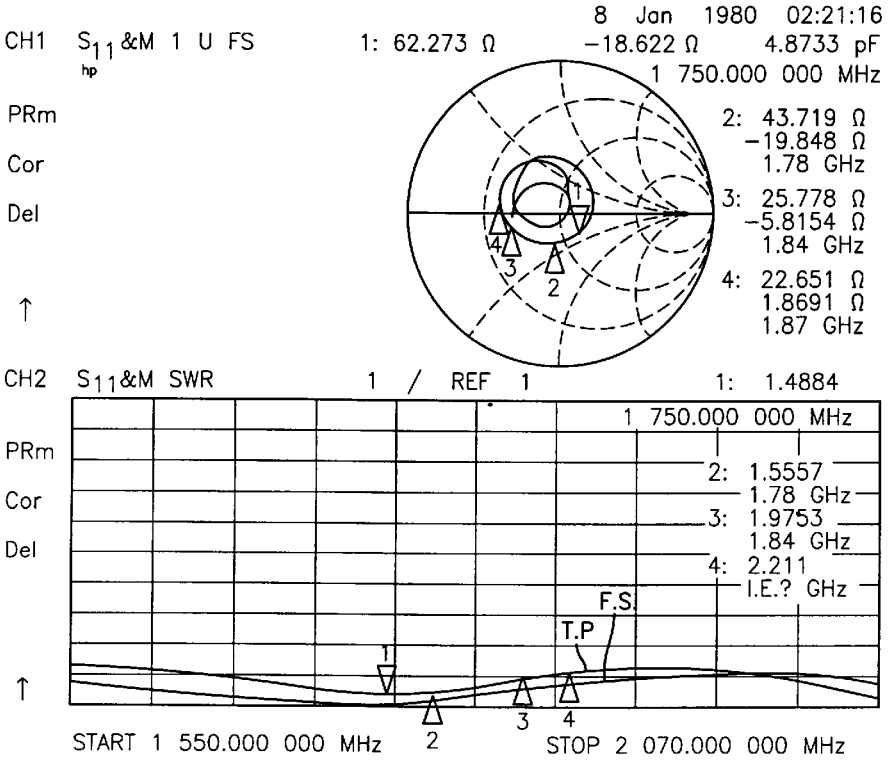
FIG. 5B (PRIOR ART)

Referring to FIG. 5*a* and FIG. 5*b*, there is shown a matching characteristic wherein FIG. 5*a* illustrates a retracted state of the antenna and FIG. 5*b* illustrates an extended state thereof. Herein, FS refers to the "Free Space" and "TP" to the "Talk Position".

Figure 7A:
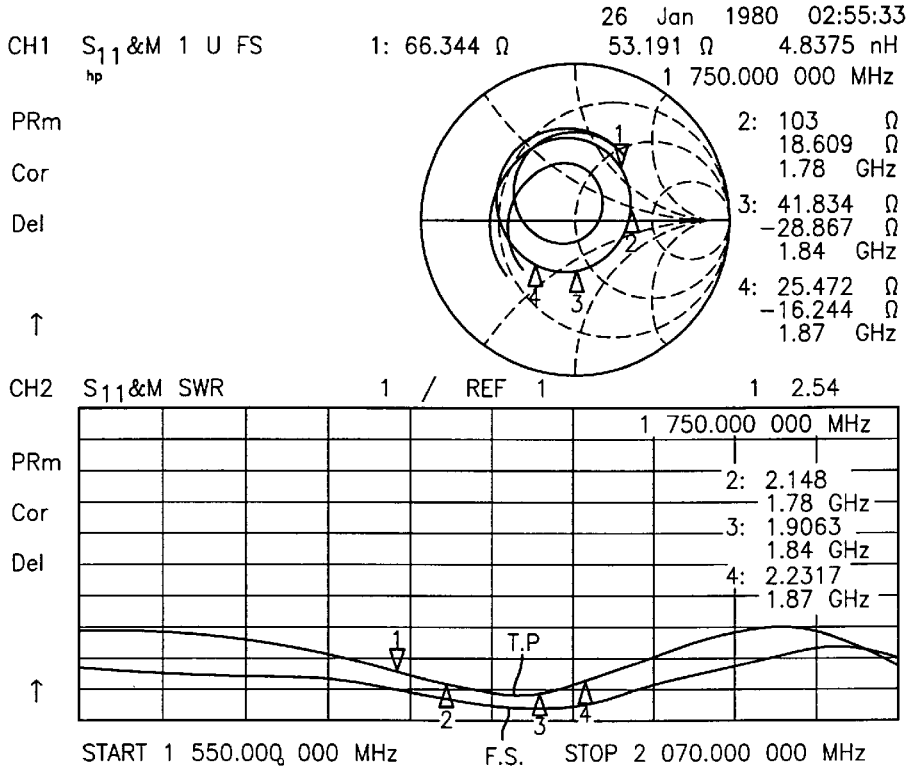
Figure 7B:
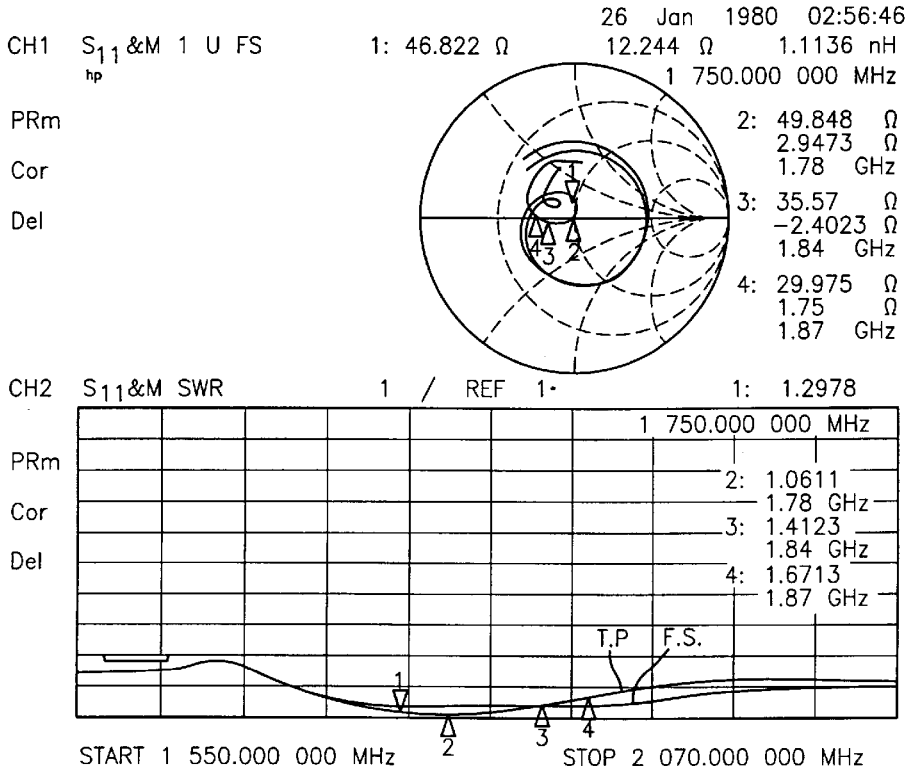

Referring to FIGS. 7*a* and 7*b*, there is shown a matching characteristic wherein FIG. 7*a* illustrates a retracted state of the antenna and FIG. 7*b* illustrates an extended state thereof.

The present invention antenna has gain/matching characteristics as illustrated in FIGS. 7*a* and 7*b* and FIGS. 8A to 8D, similar to those of the related art antenna as in FIGS. 5*a* and 5*b* and FIGS. 6A to 6D, while having a novel construction which facilitates the extension/retraction process of the antenna.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A whip antenna of an antenna structure of a mobile terminal, the antenna structure including, a helical antenna mounted to the mobile terminal and having the whip antenna passing therethrough in a lengthwise direction thereof, a bushing for fixing the helical antenna to the mobile terminal and connecting one of the helical antenna and the whip antenna to a radio frequency (RF) block, a projection for stopping extension of the whip antenna, a driving motor assembly including rollers for generating a driving force to retract/extend the whip antenna according to a specified control signal, the whip antenna comprising:

a non-conducting upper portion disposed at a position adjacent the helical antenna when the whip antenna is retracted;

an intermediate portion including a conducting wire isolated with an insulating material of a predetermined thickness, and a conducting connector having a predetermined width to be coupled to the bushing when the whip antenna is extended; and a non-conducting lower portion having the projection at the lower end thereof, wherein the upper portion, the intermediate portion and the lower portion are equal in diameter.

2. The whip antenna according to claim 1, wherein the upper portion, intermediate portion, and lower portion are equal in diameter along their respective lengths which are in contact with said motor assembly.

* * * * *